US011480906B2

(12) United States Patent
Ino

(10) Patent No.: US 11,480,906 B2
(45) Date of Patent: Oct. 25, 2022

(54) IMAGE FORMING APPARATUS THAT CONTROLS LIGHT EMISSION AMOUNT WHEN DETECTING DETECTION IMAGE

(71) Applicant: CANON KABUSHIKI KAISHA, Tokyo (JP)

(72) Inventor: Koichiro Ino, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/210,809

(22) Filed: Mar. 24, 2021

(65) Prior Publication Data

US 2021/0311423 A1 Oct. 7, 2021

(30) Foreign Application Priority Data

Apr. 1, 2020 (JP) ..... JP2020-065592

(51) Int. Cl.
*G03G 15/00* (2006.01)
*G03G 15/043* (2006.01)

(52) U.S. Cl.
CPC ..... *G03G 15/5041* (2013.01); *G03G 15/043* (2013.01); *G03G 15/5045* (2013.01); *G03G 2215/00042* (2013.01)

(58) Field of Classification Search
USPC ..... 399/49
See application file for complete search history.

(56) References Cited

U.S. PATENT DOCUMENTS 5,579,090 A 11/1996 Sasanuma
2008/0131152 A1* 6/2008 Komiya ..... G03G 15/5041 399/49
2014/0125751 A1* 5/2014 Ishikawa ..... G03G 15/043 347/118
2015/0117912 A1* 4/2015 Kamiyama ..... G03G 15/0131 399/301
2015/0346028 A1* 12/2015 Furuta ..... G01J 3/502 356/408

FOREIGN PATENT DOCUMENTS

EP 223880 A * 6/1987 ..... G01N 21/27
JP 2000029271 A 1/2000
JP 2005189704 A 7/2005

* cited by examiner

*Primary Examiner* — Quana Grainger
(74) *Attorney, Agent, or Firm* — Rossi, Kimms & McDowell LLP

(57) ABSTRACT

An image forming apparatus includes: an image forming unit configured to form an image on an image bearing member based on an image forming condition, an optical sensor including: a light emitter configured to irradiate the image bearing member with light based on a supplied current; and a light receiver configured to receive reflected light of the light emitted from the light emitter; a temperature detector configured to detect a temperature of the optical sensor; and a controller configured to: control the image forming unit to form a detection image on the image bearing member; control the optical sensor to detect reflected light from the detection image; and adjust the image forming condition based on a result of detecting the detection image by the optical sensor. The controller is configured to control the light emitter to emit light; and generate a correction condition.

6 Claims, 10 Drawing Sheets

| LED CORRECTION COEFFICIENT | LED CURRENT CORRECTION RATIO |
|---|---|
| 1 | 0.525%/°C |
| 2 | 0.550%/°C |
| 3 | 0.575%/°C |
| 4 | 0.600%/°C |
| 5 | 0.625%/°C |
| 6 | 0.650%/°C |
| 7 | 0.675%/°C |
| 8 | 0.700%/°C |
| 9 | 0.725%/°C |
| 10 | 0.750%/°C |
| 11 | 0.775%/°C |
| 12 | 0.800%/°C |
| 13 | 0.825%/°C |
| 14 | 0.850%/°C |
| 15 | 0.875%/°C |
| 16 | 0.900%/°C |

FIG. 5

IMAGE FORMING APPARATUS THAT CONTROLS LIGHT EMISSION AMOUNT WHEN DETECTING DETECTION IMAGE

BACKGROUND OF THE INVENTION

Field of the Invention

The present disclosure relates to an image thrilling apparatus such as a minter, a copying machine, a facsimile machine, or a multifunction peripheral.

Description of the Related Art

An image forming apparatus has a density correcting function of correcting an image density to provide an image with an optimal hue. With the density correcting function, a detection image for image density detection, which is formed on an image bearing member, is read by an optical sensor. Based on a result of the reading, an image density of the detection image is detected. The image density is corrected based on the image density of the detection image (U.S. Pat. No. 5,579,090 (A)).

When the image density is to be detected, it is sometimes difficult to precisely detect the detection mage depending on a state of a surface of the image hearing member. For example, when an amount of scattered reflected light from the surface of the image bearing member is large, it is difficult for an optical sensor which uses a specularly reflected light detection method to precisely detect a detection image having a small image density. Further, when the amount of scattered reflected light from the detection image having a small image density is larger than an amount of specularly reflected light from the image bearing member, it is difficult for the optical sensor which uses the specularly reflected light detection method to precisely detect the detection image having a small image density. To address this problem, there has been proposed an image forming apparatus that uses both of the optical sensor which uses the specularly reflected light detection method and an optical sensor which uses a scattered reflected light detection method to detect the image density of the detection image (Japanese Patent Application Laid-open No. 2005-189704).

The optical sensor includes a light source (light emitter) and a light receiver. The light source is configured to emit light to the detection image. The light receiver is configured to receive reflected light. For example, a light emitting diode (LED) is used as the light source. When a light emission amount of the LED changes from a predetermined amount of light, an amount of reflected light by the detection image also changes. The change in amount of reflected light hinders precise detection of the image density. To maintain the light emission amount of the LED to a predetermined amount of light, a constant current source configured to supply a constant current amount to the LED is used in a drive circuit configured to drive the LED. Further, the LED generates heat after a lapse of time from start of lighting. It is commonly known that the amount of light emitted from the LED decreases because of heat generation even when the supplied current is constant. FIG. 13 is an explanatory graph for showing a relationship between a temperature and the light emission amount of the LED. A solid line represents a change in temperature from start of lighting of the LED. A dashed line represents the light emission amount of the LED. The temperature of the LED starts rising immediately after the start of lighting of the LED, and continues rising gradually. Along with the temperature rise, the light emission amount of the LED gradually decreases. To cope with the decrease in light emission amount, there is a technology of suppressing a change in light emission amount due to a change in temperature by monitoring the light emission amount of the LED with use of the light receiver and correcting the amount of current supplied to the LED in accordance with the change in light emission amount (Japanese Patent Application Laid-open No. 2000-29271).

When the light emission amount of the LED is monitored with use of the light receiver, a variation in light reception sensitivity of the light receiver is an important factor for suppression of a change in light emission amount of the LED. When the variation in light reception sensitivity of the light receiver is large, it is difficult to precisely monitor the light emission amount of the LED to result in a variation in correction amount for correcting the light emission amount. Thus, it is difficult for the LED to emit light with a stable light emission amount. The present disclosure has been made in view of the problems described above, and has an object to control a light emission amount of a light emitter with high accuracy when a detection image is to be detected.

SUMMARY OF THE INVENTION

An image forming apparatus according to the present disclosure includes: an image forming unit configured to form an image on an image bearing member based on an image forming condition; a transferring unit configured to transfer the image into a sheet; an optical sensor including: a light emitter configured to irradiate the image bearing member with light based on a supplied current; and a light receiver configured to receive reflected light of the light emitted from the light emitter; a temperature detector configured to detect a temperature of the optical sensor; and a controller configured to: control the image forming unit to form a detection image on the image bearing member; control the optical sensor to detect reflected light from the detection age; and adjust the image forming condition based on a result of detecting the detection image by the optical sensor, wherein the controller is configured to: control the light emitter to emit light; and generate a correction condition for a current amount to be supplied to the light emitter based on a first output value from the light receiver, which is output when a first time period has elapsed from start of light emission from the light emitter, and on a second output value from the light receiver, which is output when a second time period different from the first time period has elapsed from the start of the light emission from the light emitter, and wherein the controller is configured to determine, in a case where the optical sensor detects the reflected light form the detection image, the current amount to be supplied to the light emitter from the temperature detected by the temperature detector based on the correction condition.

Further features of the present invention will become apparent from the following description of exemplary embodiments (with reference to the attached drawings).

BRIEF DESCRIPTION OF THE DRAWINGS

FIG. 5 is an explanatory table for showing LED correction coefficients.

FIG. 9A and FIG. 98 are diagrams for illustrating examples of a detection image.

DESCRIPTION OF THE EMBODIMENTS

Now, an embodiment of the present disclosure is described in detail with reference to the drawings.

≤Overall Configuration>

Figure 1:
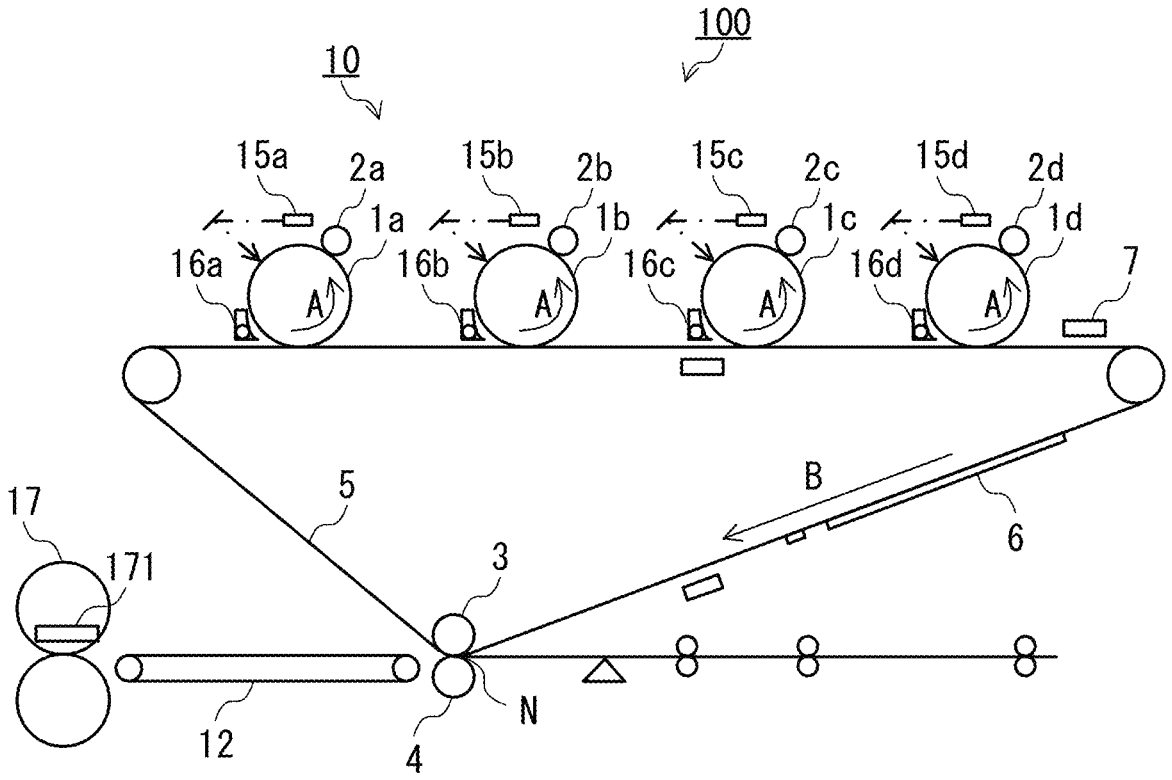
FIG. 1 is a schematic cross-sectional view of an image forming apparatus.

FIG. 1 is a schematic cross-sectional view of an image forming apparatus according to this embodiment. An image forming apparatus 100 includes photosensitive drums 1*a* to 1*d*, charging devices 2*a* to 2*d*, exposure devices 15*a* to 15*d*, developing devices 10*a* to 16*d*, an intermediate transfer belt 5, a belt support roller 3, a transfer roller 4, a conveyance belt 12, and a fixing device 17. In the following description, the photosensitive drums 1*a* to 1*d*, the charging devices 2*a* to 2*d*, the exposure devices 15*a* to 15*d*, and the developing, devices 16*a* to 16*d* are refereed to as an "image forming unit 10" configured to form yellow (Y), cyan (C), magenta (M), and black (K) toner images. The letter "a" suffixed to the reference signs represents a configuration for forming the yellow image. The letter "b" suffixed to the reference signs represents a configuration for forming the cyan image. The letter "c" suffixed to the reference signs represents a configuration for forming the magenta image. The letter "d" suffixed to the reference signs represents a configuration for forming the black image.

The intermediate transfer belt 5 is stretched around a plurality of rollers including a drive roller and the belt support roller 3. To the intermediate transfer belt 5, the toner images formed by the in forming unit 10 are transferred. The intermediate transfer belt 5 serves as an image bearing member configured to bear and convey the toner images. Moreover, the intermediate transfer belt 5 also serves as an intermediate transfer member, to which the toner images are to be transferred. The transfer roller 4 is arranged on a side opposite to the belt support roller 3 with respect to the intermediate transfer belt 5. A nip portion N formed by the transfer roller 4 pressing the intermediate transfer belt 5 is called a "transfer portion". The image (toner image) on the intermediate transfer belt 5 is transferred onto a sheet at the nip portion N (transfer portion). The sheet is conveyed to the nip portion N (transfer portion) by conveyance rollers.

The photosensitive drums 1*a*, 1*b*, 1*c*, and 1*d* are each rotated in a direction of the arrow A. The photosensitive drums 1*a*, 1*b*, 1*c*, and 1*d* each have a photosensitive layer on a surface thereof. The photosensitive drums 1*a*, 1*b*, 1*c*, and 1*d* serve as photosensitive members. The charging devices 2*a*, 2*b*, 2*c*, and 2*d* are configured to uniformly charge the surfaces of the photosensitive drums 1*a*, 1*b*, 1*c*, and 1*d*, respectively. The exposure devices 15*a*, 15*b*, 15*c*, and 15*d* are configured to expose the surfaces of the photosensitive drums 1*a*, 1*b*, 1*c*, and 1*d*, which are charged by the charging devices 2*a*, 2*b*, 2*c*, and 2*d*, respectively, to light. The photosensitive drums 1*a*, 1*b*, 1*c*, and 1*d* are scanned with laser light emitted from the exposure devices 15*a*, 15*b*, 15*c*, and 15*d* so that electrostatic latent images are thrilled on the surfaces of the photosensitive drums 1*a*, 1*b*, 1*c*, and 1*d*, respectively. The developing devices 16*a*, 16*b*, 16*c*, and 16*d* are configured to develop the electrostatic latent images mitt developer (toner) to form the toner images of respective colors on the photosensitive drums 1*a*, 1*b*, 1*c*, and 1*d*, respectively. The drive roller of the intermediate transfer belt 5 is rotated to rotate the intermediate transfer belt 5 in a direction of the arrow B. The toner images of respective colors formed on the photosensitive drums 1*a*, 1*b*, 1*c*, and 1*d* are sequentially transferred onto the intermediate transfer belt 5, which is the image bearing member, in an overlapping manner. As a result, a full-color toner image 6 is formed on the intermediate transfer belt 5.

The intermediate transfer belt 5 is rotated to convey the toner image 6 to the transfer portion. The toner image 6 is transferred onto the sheet when passing through the transfer portion. The sheet having the toner image 6 transferred thereto is conveyed to the fixing device 17 by the conveyance belt 12. The fixing device 17 includes a heater 171. The fixing device 17 causes the heater 171 to heat the toner image 6 to fix the toner image 6 onto the sheet. Then, the sheet is delivered to a tray (not shown) of the image forming apparatus 100. In this manner, image forming, processing by the image forming apparatus 100 is ended.

On a downstream side of the photosensitive drum 1*d* in a conveyance direction (direction B) of the intermediate transfer belt 5, an optical sensor 7 is arranged. The optical sensor 7 is configured to detect a detection image for image density detection, which is formed on the intermediate transfer belt 5. A result of detecting the detection image by the optical sensor 7 is used to determine a correction amount for image density correction.

The image forming apparatus 100 varies in density of the image to be formed due to, for example, a usage environment (temperature and humidity) and a frequency in use of respective colors. To address this problem, the image forming apparatus 100 is configured to detect the detection image by the optical sensor 7, and perform image density correction, in which an image forming condition is controlled based on a result of detecting the detection image. In this case, the image forming condition includes intensities of laser light to be emitted by the exposure devices 15*a* to 15*d*, developing biases to be applied to the developing devices 16*a* to 16*d*, charging biases to be applied to the charging devices 2*a* to 2*d*, or transfer biases to be applied to the transfer roller 4, for example. In order to correct the image density, the image forming apparatus 100 may control a plurality of image forming conditions, or control only a particular image forming condition.

<Optical Sensor>

Figure 2A:
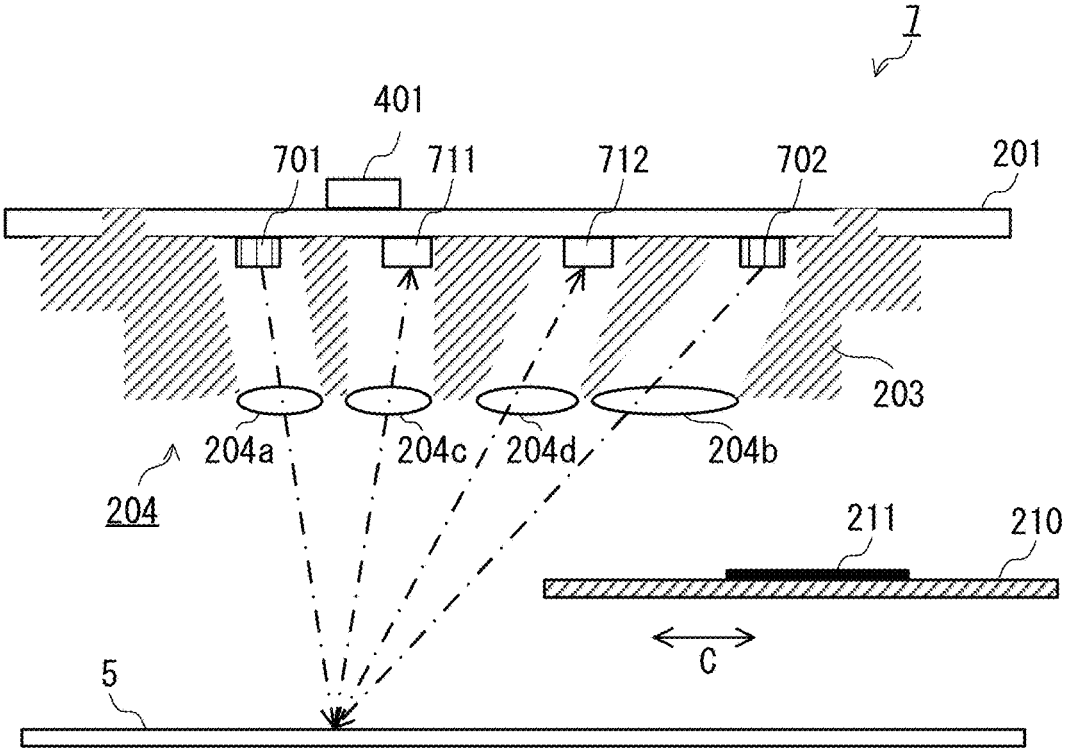
FIG. 2A and FIG. 2B are explanatory views of an optical sensor.
Figure 2B:
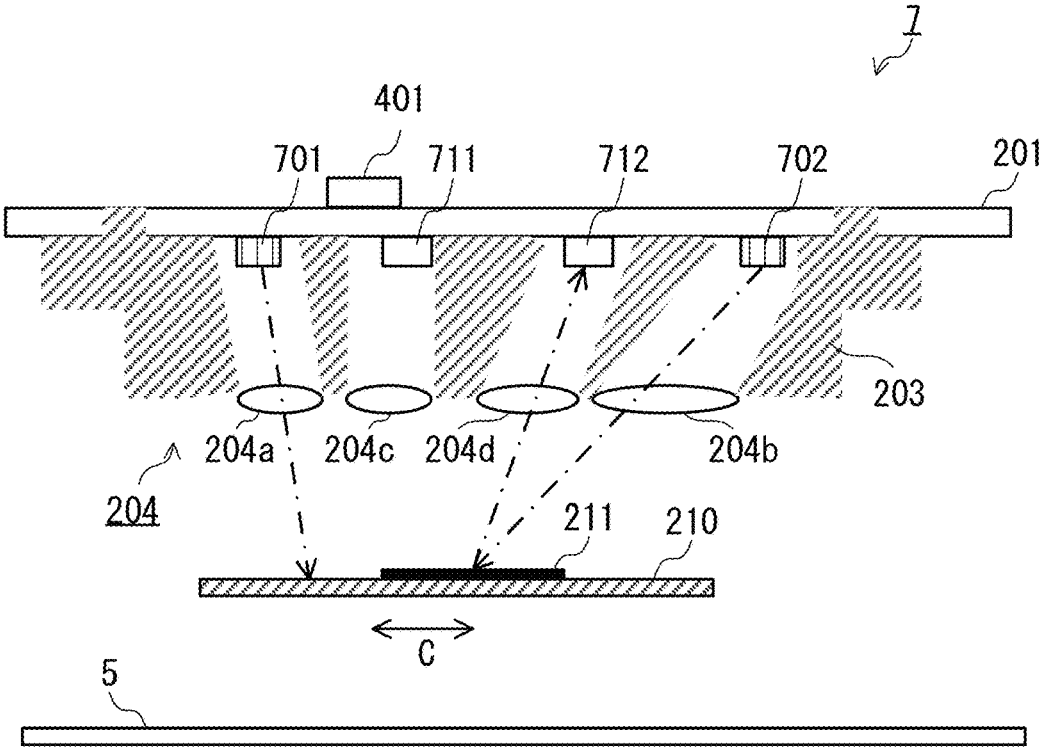

FIG. 2A and FIG. 2B are explanatory views of the optical sensor 7. The optical sensor 7 includes light emitting elements serving as a light emitter and light receiving elements serving as a light receiver. The optical sensor 7 includes two LEDs (first LED 701 and second LED 702) as the light emitting elements. The optical sensor 7 includes two photodiodes (PDs) (first PD 711 and second PD 712) as the light receiving elements. The first LED 701, the second LED 702, the first PD 711, and the second PD 712 are surface-mounted components that me mounted on a predetermined surface (mounting surface) of the same substrate 201. A sensor controller 401 configured to control an operation of the optical sensor 7 is mounted onto a surface of the substrate 201, which is opposite to the mounting surface. The sensor controller 401 is formed of, for example, a semiconductor device.

A configuration of the optical sensor 7 is now described with reference to FIG. 2A. In the optical sensor 7, the first LED 701 and the first PD 711 are arranged such that specularly reflected light of light (irradiation light) emitted from the first LED 701 to the intermediate transfer belt 5 is received by the first PD 711. The first PD 711 is a light receiver configured to receive the specularly reflected light of the irradiation light emitted from the first LED 701, which is reflected by the intermediate transfer belt 5. The second LED 702 and the second PD 712 are arranged such that scattered reflected light of light (irradiation light) emitted from the second LED 702 to the intermediate transfer belt 5 is received by the second PD 712, The second PD 712 is a light receiver configured to receive the scattered reflected light of the irradiation tight emitted by the second LED 702, which is reflected by the intermediate transfer belt 5.

A housing 203 is mounted to the substrate 201. The housing 203 forms light guide paths for guiding irradiation light so that light emitted from the first LED 701 and the second LED 702 efficiently irradiate the intermediate transfer belt 5. The housing 203 also forms light guide paths for guiding the reflected light so that the first PD 711 and the second PD 712 efficiently receive the reflected light from the intermediate transfer belt 5. A lens group 204 formed of lenses 204*a* to 204*d* is provided in the light guide paths for guiding the irradiation light and the light guide paths for guiding the reflected. light.

In other words, the light emitted from the first LED 701 travels in the direction of the optical axis (dash-dotted line of FIG. 2A and FIG. 2B), through the light, guide path and the lens 204*a* formed inside the housing 203, and irradiates the intermediate transfer belt 5. The first PD 711 receives the specularly reflected light of the light emitted from the first LED 701 to the intermediate transfer belt 5 through the light guide path and the lens 204*c* inside the housing 203. The light emitted from the second LED 702 travels in the direction of the optical axis dash-dotted line of FIG. 2A and FIG. 2B), through the light guide path and the lens 204*b* inside the housing 203, and irradiates the intermediate transfer belt 5. The second PD 712 receives the scattered reflected light of the light emitted from the second LED 702 to the intermediate transfer belt 5, through the light guide path and the lens 204*d* inside the housing 203.

The first LED 701, the second LED 702, the first PD 711, and the second PD 712 are mounted on the same substrate 201, and hence the elements can be mounted substantially in parallel to the intermediate transfer belt 5. Therefore, a shift of the optical axis from a design center value can be reduced as compared to the case of forming the elements by bullet elements with lead pins, for example. Further, the first LED 701, the second LED 702, the first PD 711, and the second PD 712 are surface mount elements, and hence can be reduced in element interval. Therefore, the entire size of the optical sensor 7 can be reduced. For example, while dimensions of a general surface mount element are about 3 mm×2 mm×1 mm, dimensions of a bullet element are about 5 mm×10 mm×5 mm even without the lead pins. Therefore, a part volume can be significantly reduced and the optical sensor 7 itself can be downsized.

A shutter 210 supported by a member (not shown is arranged between the optical sensor 7 and the intermediate transfer belt 5. The shutter 210 can be moved by a drive source (not shown) in directions indicated by arrows C of FIG. 2A. At a time of normal image formation for a print job, the shutter 210 is located between the optical sensor 7 and the intermediate transfer belt 5, as illustrated in FIG. 2B. With the positioning described above, the shutter 210 can prevent adhesion of dirt to the optical sensor 7 due to, for example, scattering of toners of the toner image formed on the intermediate transfer belt 5. In FIG. 2B, the shutter 210 in a closed state is illustrated. A reference reflective sheet 211 corresponding to a reference member is bonded to a side of the shutter 210, which is closer o the optical sensor 7. The reference reflective sheet. 211 is arranged at a position at which the light from the second LED 702 is incident thereon when the shutter 210 is in the closed state.

At a time of detection of the image density, which is described later, the shutter 210 is moved to such a position as not to block light paths for the irradiation light from the optical sensor 7 and the reflected light from the intermediate transfer belt 5 as illustrated in FIG. 2A. In FIG. 2A, the shutter 210 in an open state is illustrated.

<Controller>

Figure 3:
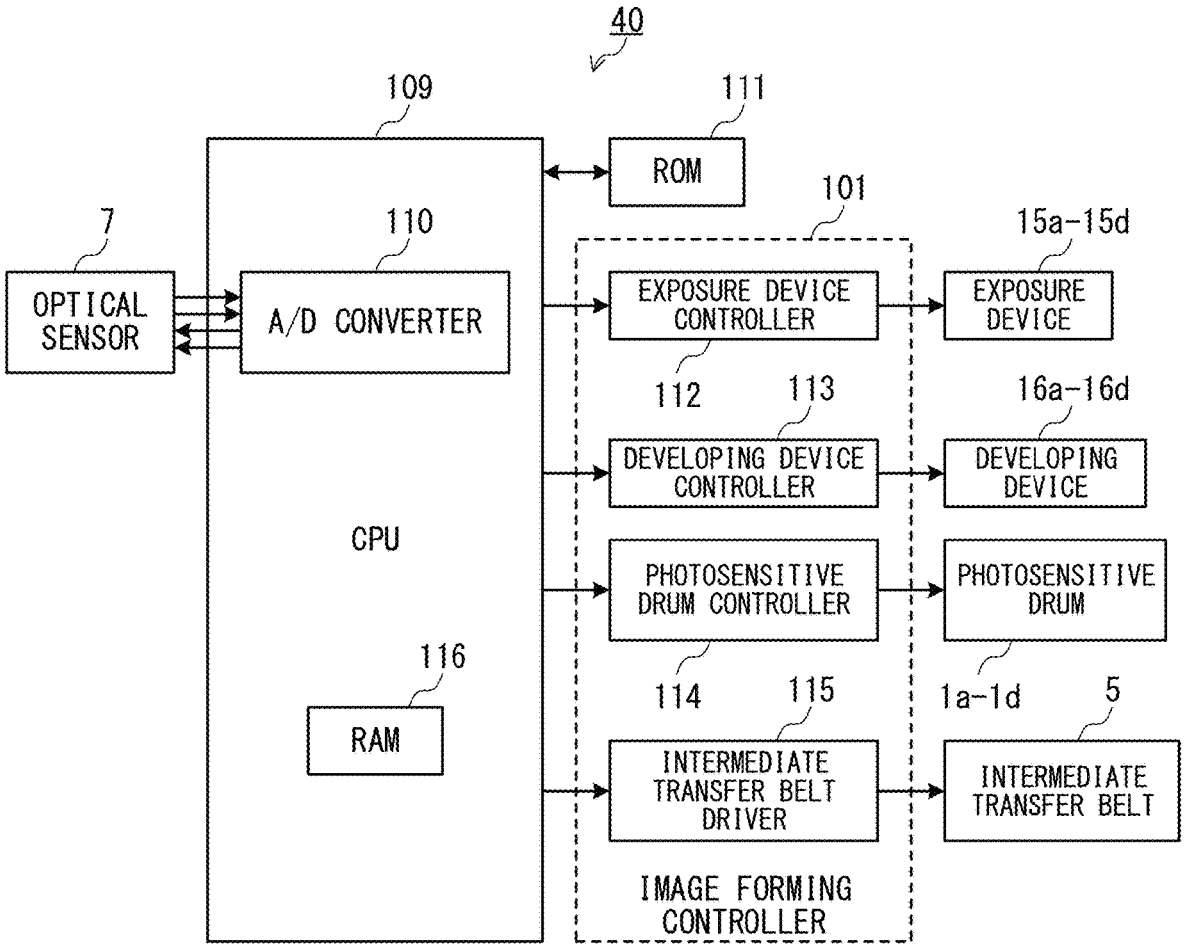
FIG. 3 is a diagram for illustrating an example of a configuration of a controller.

FIG. 3 is a diagram for illustrating an example of a configuration of the controller configured to control the image forming apparatus 100. A controller 40 includes a central processing unit (CPU) 109, a read-only memory (RUM) 111, and an image forming controller 101. The CPU 109 includes an A/D converter 110 and a random access memory (RAM) 116. The image forming controller 101 includes an exposure device controller 112, a developing device controller 113, a photosensitive drum controller 114, and an intermediate transfer belt driver 115. The exposure device controller 112 is configured to control output of laser light emitted from light sources included in the exposure devices 15*a* to 15*d*. The developing device controller 113 is configured to control motors for rotating developing rollers included in the developing devices 16*a* to 16*d*. The photosensitive drum controller 114 is configured to control motors for rotating the photosensitive drums 1*a* to 1*d*. The intermediate transfer belt driver 115 is configured to control a motor for rotating the intermediate transfer belt 5.

The CPU 109 is configured to control the image forming apparatus 100 by executing a computer program stored in the ROM 111. The ROM 111 stores, in addition to the computer program, detection image data to be used to form the detection image for image density detection, which is described later, and LED correction coefficients also described later. The RAM 116 provides a work area for processing to be performed by the CPU 109. Further, the RAM 116 temporarily stores, for example, a set value to be used for control of the image forming apparatus 100. The controller 40 may be implemented not only by executing the computer program, but also by a discrete part or a one-chip semiconductor product. The one-chip semiconductor product includes a micro-processing unit (MPU), an application specific integrated circuit (ASIC), or a system-on-a-chip (SOC), for example.

When the image density correction is to be performed, the CPU 109 controls the image forming controller 101 based on the detection image data stored in the ROM 111. Through the control, the image forming controller 101 controls the exposure devices 15*a* to 15*d*, the developing devices 16*a* to 16*d*, and the photosensitive drums 1*a* to 1*d* to form the detection image for detection of the image density on the intermediate transfer belt 5.

The CPU 109 is configured to control the optical sensor 7 to control the first LED 701 and the second LED 702 to independently emit light (be lit). In this embodiment, the LED correction coefficients described later are stored in the ROM 111. The CPU 109 sets the LED correction coefficients to the optical sensor 7. The optical sensor 7 performs lighting control on the first LED 701 and the second LED 702 with current amounts in accordance with the LED correction coefficients.

The first LED 701 and the second LED 702 of the optical sensor 7 irradiate a surface (front surface) of the intermediate transfer belt 5, on which the detection image is formed, and the detection image formed on the intermediate transfer belt 5. The first PD 711 and the second PD 712 receive the reflected light from the front surface of the intermediate transfer belt 5 and the detection image formed on the intermediate transfer belt 5. The first PD 711 and the second PD 712 each output an electrical signal obtained by converting the received reflected light into a voltage. The optical sensor 7 amplifies the electrical signals output from the first PD 711 and the second PD 712 to output analog signals as results of detection. The CPU 109 acquires the analog signals output from the first PD 711 and the second PD 712 through the intermediation of the A/D converter 110. The CPU 109 detects an image density based on digital signals converted from the analog signals through the A/D converter 110. The CPU 109 corrects the image density based on the detected image density. In this manner, the CPU 109 generates the image forming condition for correcting the image density, <Sensor Controller>

Figure 4:
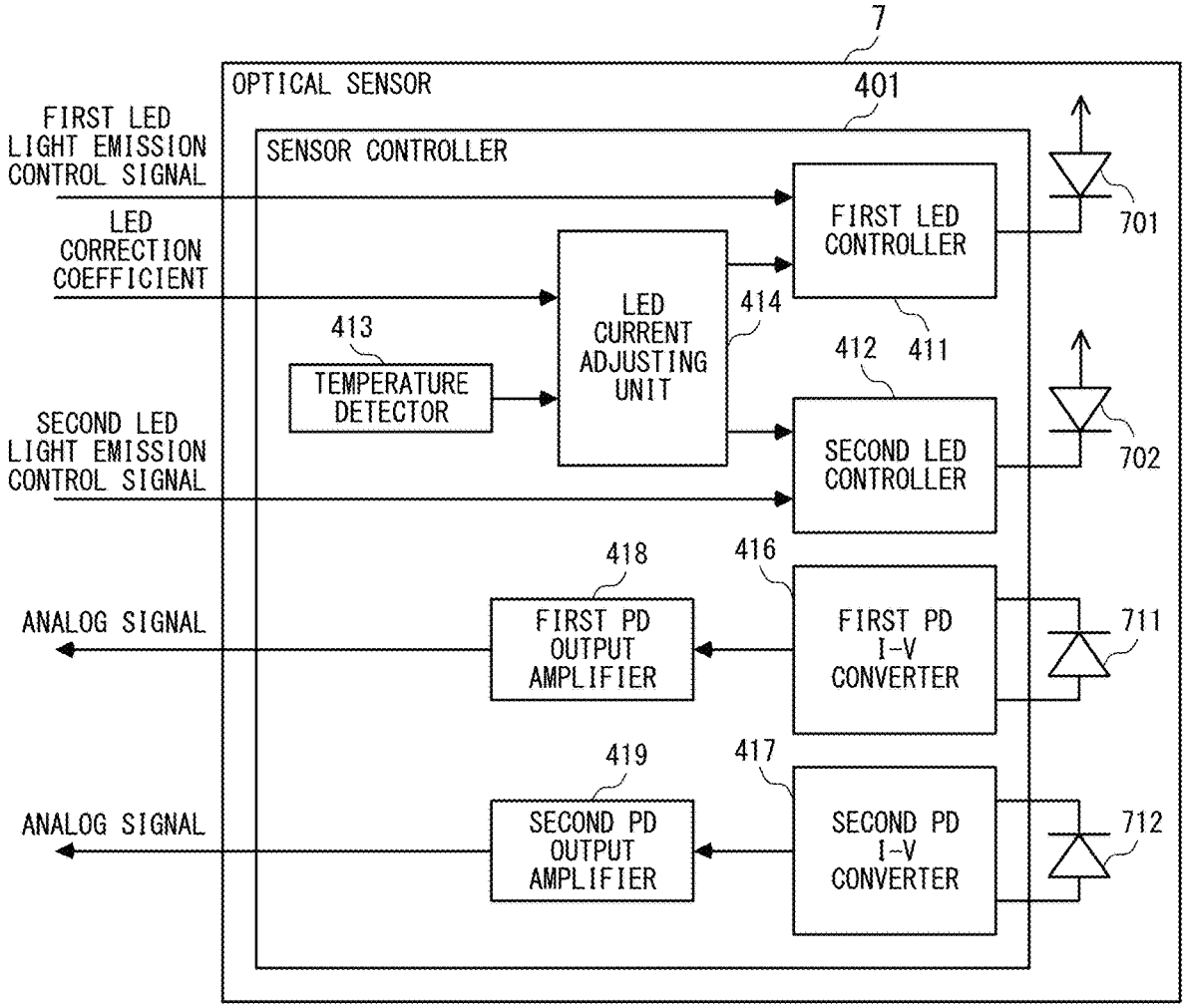
FIG. 4 is an explanatory diagram of a sensor controller.

FIG. 4 is an explanatory diagram of the sensor controller 401 of the optical sensor 7. The sensor controller 401 is controlled by the CPU 109 to control operations of the first LED 701, the second LED 702, the first PD 711, and the second PD 712. The sensor controller 401 includes a first LED controller 411, a second LED controller 412, a temperature detector 413, and an LED current adjusting unit 414 so as to control the operations of the first LED 701 and the second LED 702. The sensor controller 401 includes a first PD I-V converter 416, a second PD I-V converter 417, a first PD output amplifier 418, and a second PD output amplifier 419 so as to output the analog signals based on the electrical signals output from the first PD 711 and the second PD 712.

The first LED controller 411 is configured to control turn-on/turn-off of the first LED 701 based on a first LED light emission control signal acquired from the CPU 109. The second LED controller 412 is configured to control turn-on/turn-off of the second LED 702 based on a second LED light emission control signal acquired from the CPU 109. The temperature detector 413 is configured to detect a temperature of the optical sensor 7. The sensor controller 401 is arranged in the vicinity of the first LED 701 and the second LED 702. Thus, the temperature detector 413 can detect temperatures of the first LED 701 and the second LED 702. The LED current adjusting unit 414 is configured to adjust current amounts supplied to the first LED 701 and the second LED 702 based on the temperature of the optical sensor 7, which has been detected b the temperature detector 413, and the LED correction coefficients. The first LED controller 411 is configured to supply a current with a current amount directed by the LED current adjusting unit 414 to the first LED 701. The second LED controller 412 is configured to supply a current with a current amount directed by the LED current adjusting unit 414 to the second LED 702. Light amounts of the irradiation light to be emitted by the first LED 701 and the second LED 702 are determined by the supplied current amounts.

The first PD I-V converter 416 is configured to convert the current (electrical signal) corresponding to alight amount (intensity) of reflected light, which is output from the first PD 711, into a voltage. The first PD output amplifier 418 is configured to amplify the voltage, which has been obtained through I-V conversion performed by the first PD I-V converter 416, to a suitable level which allows the CPU 109 to process the voltage. The second PD I-V converter 417 is configured to convert the current (electrical signal) corresponding to a light amount (intensity) of reflected light, which is output from the second PD 712, into a voltage. The second PD output amplifier 419 is configured to amplify the voltage, which has been obtained through I-V conversion performed by the second PD I-V converter 417, to a suitable level which allows the CPU 109 to process the voltage. The CPU 109 acquires the amplified voltage as the analog signal.

<Current Correction>

Figure 13:
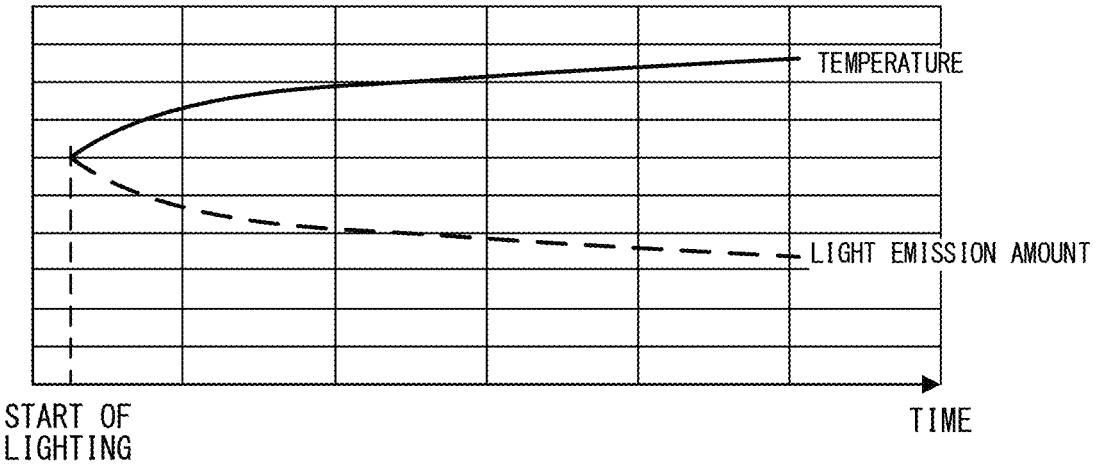
FIG. 13 is an explanatory graph for showing a relationship between a temperature and a light emission amount of an LED.

FIG. 5 is an explanatory table of the LED correction coefficients. The LED correction coefficients are stored M the ROM 111, for example, in the form of a table as shown in FIG. 5. As described above with reference to FIG. 13, even when a constant current is continuously supplied, the light emission amount (amount of the irradiation light) from the LED decreases as its temperature vises. Thus, the current to be supplied to the LED is increased so as to compensate for a decrease in light emission amount along with the temperature rise. An LED current correction ratio for adjusting the current amount of the current to be supplied to the LED is set in accordance with the LED correction coefficient. The LED current correction ratio is a correction condition for a current amount, which represents a correction ratio for the current amount to be supplied to the LED for each degree in Celsius. For example, when the LED correction coefficient is set to "1", the LED current correction ratio is 0.525% PC. In this case, each time the temperature detected by the temperature detector 413 rises by 1° C., the current amount supplied to the LED is controlled to be increased by 0.525%. In this embodiment, as the LED correction coefficient increases, a correction amount for the current amount flowing through the LED increases.

Figure 6A:
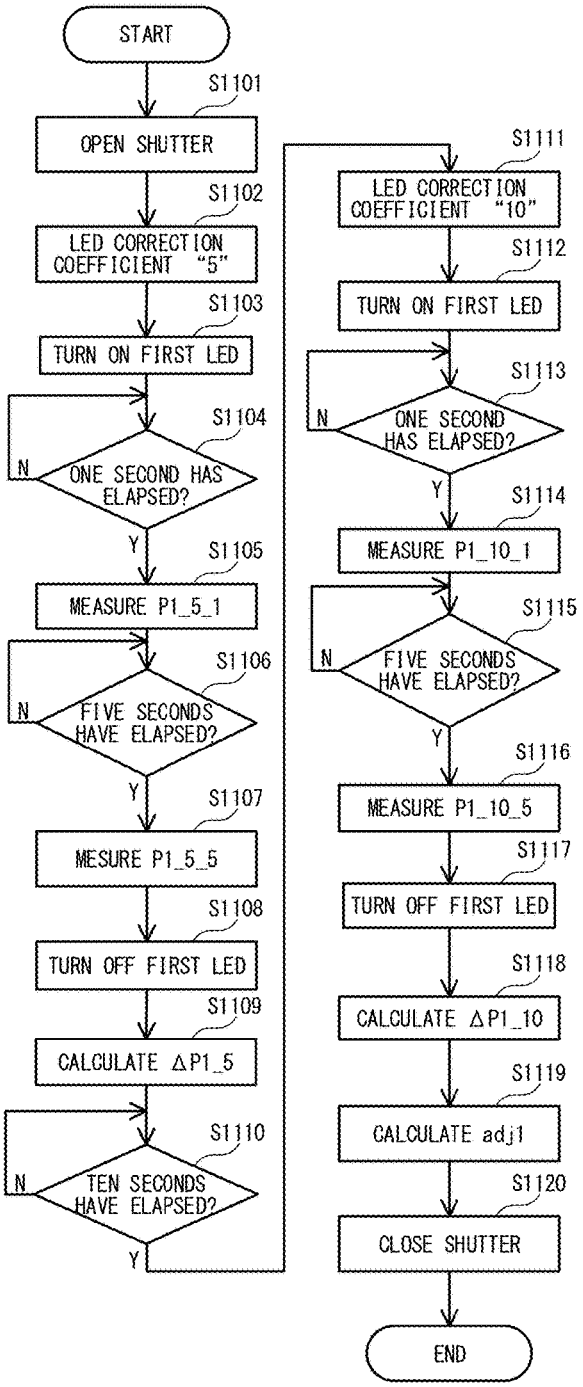
FIG. 6A and FIG. 6B are flow charts for illustrating LED correction coefficient determining processing.
Figure 6B:
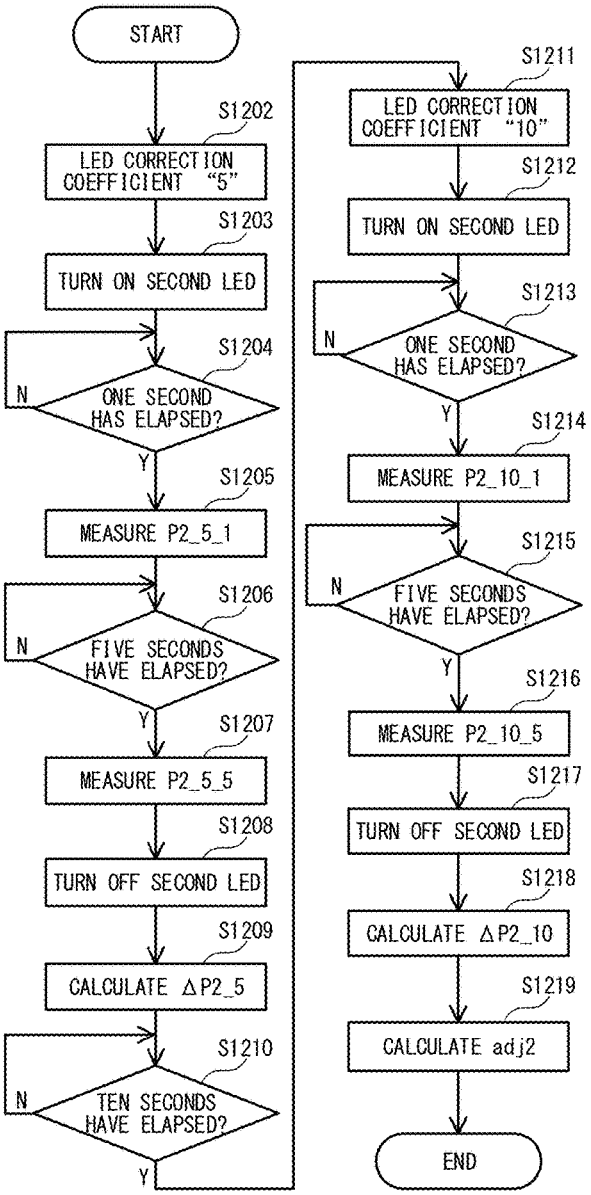
Figure 7:
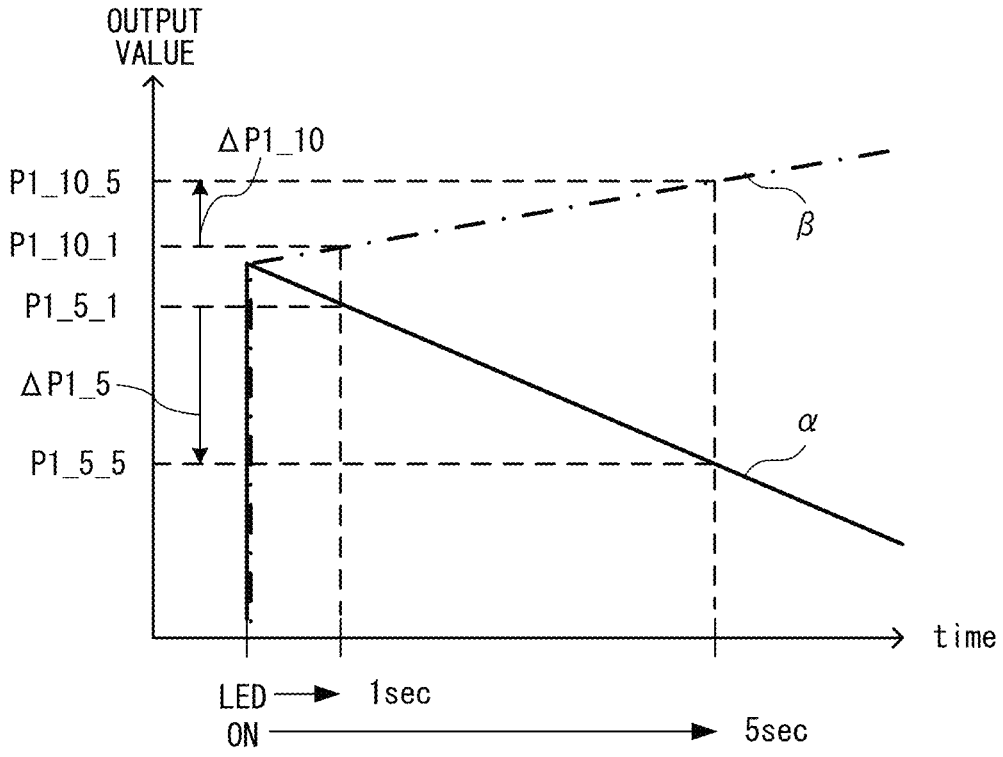
FIG. 7 is a graph for showing an example of a shift in output value over time.

FIG. 6A and FIG. 6B are flow charts for illustrating LED correction coefficient determining processing for stabilizing the light emission amounts of the first LED 701 and the second LED 702. FIG. 6A is a flow chart for illustrating, processing of determining the LED correction coefficient for the first LED 701. FIG. 6B is a flow chart for illustrating processing of determining the LED correction coefficient for the second LED 702. FIG. 7 is a graph for showing an example of a shift in value (output value) of the analog signal output from the first PD 711 over time. When the LED correction coefficient is to be determined, the toner image 6 is not formed on the intermediate transfer belt 5.

When an LED correction coefficient (first LED correction coefficient adj1) for the first LED 701 is to be determined, the CPU 109 first brings the shutter 210 into an open state (see FIG. 2A) (Step S1101). After the shutter 210 is brought into the open state, the intermediate transfer belt 5 is irradiated with the irradiation light emitted from the first LED 701. The specularly reflected light of the irradiation light is received by the first PD 711.

The CPU 109 reads out the table of the LED correction coefficients, which is stored in the ROM 111, to set the LED current correction ratio corresponding to the LED correction coefficient "5" to the LED current adjusting unit 414 of the optical sensor 7 (Step S1102). In the example of FIG. 5, the LED current correction ratio is, 0.625%/° C. for the LED correction coefficient "5". After that, the CPU 109 turns on the first LED 701 to start lighting the first LED 701 (Step S1103). When one second has elapsed from the start of lighting of the first LED 701 (Step S1104: Y), the CPU 109 measures an output value from the first PD 711. The output value is set as P1_5_1 (Step S1105). Subsequently, when five seconds have elapsed from the start of lighting of the first LED 701 (Step S1106: Y), the CPU 109 measures an output value from the first PD 711. The output value is set as P1_5_5 (Step S1107). A solid line α of FIG. 7 represents a shift in output value from the first PD 711 in the above-mentioned steps. During the processing from Step S1103 to Step S1107, the LED current adjusting unit 414 adjusts the current amount to be supplied to the first LED 701 at the LED current correction ratio corresponding to the LED correction coefficient "5" in accordance with the temperature detected by the temperature detector 413. In this case, when a reduction in light emission amount from the LED, which is caused along with the temperature rise of the LED, and an increase in light emission amount from the LED which is caused along with the increase in current supply amount to the LED in accordance with the temperature detected by the temperature detector 413, are compared with each other, the reduction in light emission amount from the LED, which is caused along with the temperature rise of the LED is larger. Consequently, the output value from the first PD 711 decreases along with the elapse of time.

After measuring the output values P1_5_1 and P1_5_5, the CPU 109 turns off the first LED 701 (Step S1108). After turning off the first LED 701, the CPU 109 calculates a change amount ΔP1_5, which is a difference between output value P1_5_1 and the output value P1_5_5 (Step S1109).

When ten seconds have elapsed from the turn-off of the first LED 701 (Step S1110: V), the CPU 109 sets the LED current correction ratio corresponding to the LED correction coefficient "10" to the LED current adjusting unit 414 (Step S1111). In the example of FIG. 5, the LED current correction ratio is 0.750%/° C. for the LED correction coefficient "10". After that, the CPU 109 turns on the first LED 701 to start lighting the first LED 701 again (Step S1112). In this case, a light-off time period of the first LED 701 is set to ten seconds. However, the light-off time period is not limited to ten seconds. The light-off time period may be set to a predetermined time period from the turn-off of the first LED 701 to a time at which the temperature of the first LED 701 has decreased. to a given level. When one second has elapsed from the start of re-lighting of the first LED 701 (Step S1113: Y), the CPU 109 measures an output value from the first PD 711. The output value is set as P1_10_1 (Step S1114). Subsequently, when five seconds have elapsed from the start of re-lighting of the first LED 701 (Step S1115: Y), the CPU 109 measures an output value from the first PD 711. The output value is set as P1_10_5 (Step S1116). A dash-dotted line of FIG. 7 represents a shift in output value from the first PD 711 in the above-mentioned steps. From Step S1112 to Step S1116, the LED current adjusting unit 414 adjusts the current amount to be supplied to the first LED 701 at the LED current correction ratio corresponding to the LED correction coefficient "10" in accordance with the temperature detected by the temperature detector 413. In this, case, when a reduction in light emission amount from the LED, which is caused along with the temperature rise of the LED, and an increase in light emission amount from the LED, which is caused along with the increase in current supply amount to the LED in accordance with the temperature detected by the temperature detector 413, are compared with each other, the increase m light emission amount from the LED, which is caused along with the increase in current supply amount to the LED, is larger. Consequently, the output value from the first PD 711 increases along with the elapse of time.

After measuring the output values, the CPU 109 turns off the first LED 701 (Step S1117). After turning off the first LED 701, the CPU 109 calculates a change amount ΔP1_10, which is a difference between the output value P1_10_1 and the output value P1_10_5 (Step S1118). The CPU 109 calculates the first LED correction coefficient adj1 from the change amount ΔP1_5 and the change amount ΔP1_10, which have been calculated (Step S1119). After calculating the first LED correction coefficient adj1, the CPU 109 brings the shutter 210 into a closed state (Step S1120).

Figure 8:
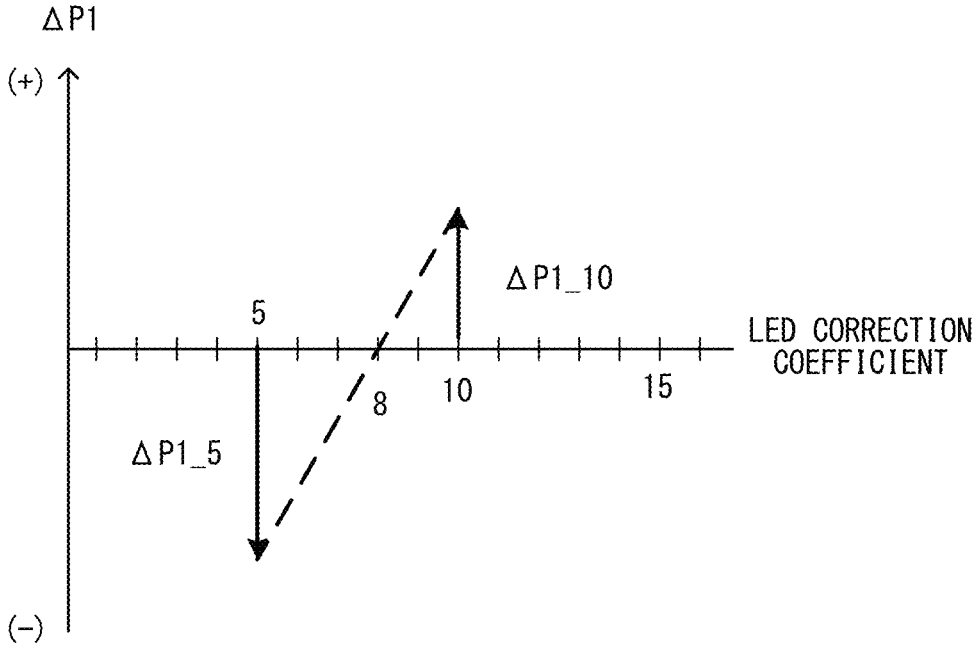
FIG. 8 is, a graph for showing an example of a relationship between a change amount ΔPI and the LED correction coefficient.

Processing of calculating the first LED correction coefficient adj1 is now described. The first LED correction coefficient adj1 is such a value that reduces an absolute value of the change amount ΔP1 of the output value from the first PD 711. FIG. 8 is a graph for showing an example of a relationship between the change amount ΔP1 and the LED correction coefficient. In FIG. 8, the change amount ΔP1)_5 is "−6", and the change amount ΔP1_10 is "+4". The LED correction coefficient with which the change amount ΔP1 is minimized is "8".

Specifically, as the first LED correction coefficient adj1, an optimal value is calculated by the following expression. The LED correction coefficient is an integer. Thus, when a result of calculation is not an integer, the result of calculation is, for example, rounded to an integer.

$$adj1=5\times(\Delta P1_10-2\times\Delta P1_5)/(\Delta P1_10-\Delta P1_5)$$

When an LED correction coefficient (second LED correction coefficient adj2) for the second LED 702 is to be determined, the shutter 210 is left in the closed state (see FIG. 2B). When light is emitted from the second LED 702 while the shutter 210 is left in the open state and the scattered reflected light from the intermediate transfer belt 5 is received by the second PD 712, the output value from the second PD 712 is extremely small because of a low scattering reflectance of the intermediate transfer belt 5. When the output value is extremely small, it is difficult to detect a shift in output value from the second PD 712 after the start of lighting of the LED. Thus, when the LED correction coefficient for the second LED 702 is to be determined, the reflected light from the reference reflective sheet 211 is used under a state in which the shutter 210 is closed.

The CPU 109 reads out the table of the LED correction coefficients, which is stored in the ROM 111, to set the LLD current correction ratio corresponding to the LED correction coefficient "5" to the LED current adjusting unit 414 of the optical sensor 7 (Step S1202). In the example of FIG. 5, the LED current correction ratio is 0.625%/° C. for the LED correction coefficient "5". After that, the CPU 109 turns on the second LED 702 to start lighting the second LED 702 (Step S1203). When one second has elapsed from the start of lighting of the second LED 702 (Step S1204: Y), the CPU 109 measures an output value from the second PD 712. The output value is set as P2_5_1 (Step S1205). Subsequently, when five seconds have elapsed from the start of lighting of the second LED 702 (Step S1206: Y), the CPU 109 measures an output value from the second PD 712. The output value is set as P2_5_5 (Step S1207). During the processing from Step S1203 to Step S1207, the LED current adjusting unit 414 adjusts the current amount to be supplied to the second LED 702 at the LED current correction ratio corresponding to the LED correction coefficient "5" in accordance with the temperature detected by the temperature detector 413.

After measuring the output values, the CPU 109 turns off the second LED 702 (Step S1208). After turning off the second LED 702, the CPU 109 calculates a change amount ΔP2_5, which is a difference: between the output value P2_5_1 and the output value P2_5_5 (Step S1209).

When ten seconds have elapsed from the turn-off of the second LED 702 (Step S1210: Y), the CPU 109 sets the LED current correction ratio corresponding to the LED correction coefficient "10" (Step S1211). In the example of FIG. 5, the LED current correction ratio is 0.750%/° C. for the LED correction coefficient "10". After that, the CPU 109 turns on the second LED 702 to start lighting the second LED 702 again (Step S1212). In this case, a light-off ti me period of the second LED 702 is set to ten seconds. However, the light-off time period is not limited to ten seconds. The light-off time period may be set to a predetermined time period from the turn-off of the second LED 702 to a time at which the temperature of the second LED 702 has decreased to a given level. When one second has elapsed from the start of re-lighting of the second LED 702 (Step S1213: Y), the CPU 109 measures an output value from the second PD 712. The output value is set as P2_10_1 (Step S1214). Subsequently, when live seconds have elapsed from the start of re-lighting of the second LED 702 (Step S1215: Y), the CPU 109 measures an output value from the second PD 712. The output value is set as P2_10_5 (Step S1216). From Step S1212 to Step S1216, the LED current adjusting unit 414 adjusts the current amount to be supplied to the second LED 702 at the LED current correction ratio corresponding to the LED correction coefficient "10" in accordance with the temperature detected by the temperature detector 413.

After measuring the output values, the CPU 109 turns off the second LED 702 (Step S1217). After turning off the second LED 702, the CPU 109 calculates a change amount ΔP2_10, which is a difference between the output value P2_10_1 and the output value P2_10_5 (Step S1218), The CPU 109 calculates the second LED correction coefficient adj2 from the change amount ΔP2_5 and the chance amount ΔP2_10, which have been calculated (Step S1219). A shift in output value from the second PD 712 is similar to that in output value from the first PD 711, and thus a detailed description thereof is herein omitted. Further, processing of calculating the second LED correction coefficient adj2 is also similar to the processing of calculating the first LED correction coefficient adj1 with use of the output value from the first PD 711, and thus a detailed description thereof is herein omitted.

Through the processing described above, the first LED correction coefficient adj1 for the first LED 701 and the second LED correction coefficient adj2 for the second LED 702 are calculated. The CPU 109 stores the first LED correction coefficient adj1 and the second LED correction coefficient adj2, which have been calculated, in the RAM 116. The processing requires several tens of seconds. Hence, it is preferred that the processing be performed when there is sufficient time for a control time period, for example, at a time of start-up of the image forming apparatus 100.

As described above, the LED correction coefficient is determined based on the change amount in output value between the output value output from the PD when a first predetermined time period has elapsed from the start of light emission from the LED and the output value output from the PD when a second predetermined time period has elapsed from the start of light emission from the LED. The LED correction coefficient is determined to minimize the change amount. Thus, an optimal current amount is supplied to the LED for a change in temperature. As a result, the LED can emit light with a constant light amount.

<Detection Image>

Figure 9A:
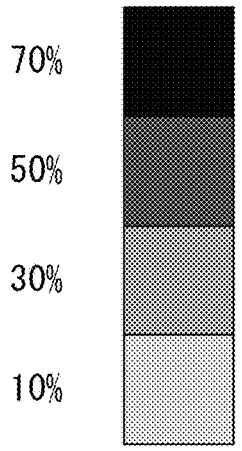
Figure 9B:
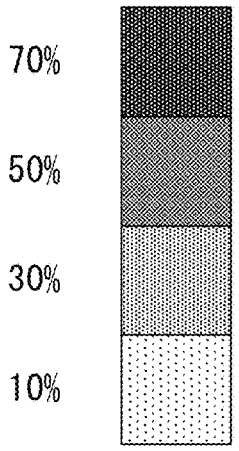

FIG. 9A and FIG. 9B are diagrams for illustrating examples of detection images for the image density detection, which are each an example of an image for adjusting the image forming condition. In FIG. 9A, an example of a first detection image for the image density detection to be detected with the specularly reflected light is illustrated. In FIG. 9B, an example of a second detection image for the image density detection to be detected with scattered reflected light is illustrated.

The first detection image is used when the specularly reflected light of the light emitted from the first LED 701 is received by the first PD 711. The first detection image is used in detecting an image density of black, in particular. The black toner has a property of absorbing light, and hence an amount of scattered reflected light from a detection image of black is extremely small. Therefore, when a density of an image formed by the black toner is to be detected, the CPU 109 detects specularly reflected light from the detection image of black. The first detection image is formed of a tone pattern of four image densities: 70%, 50%, 30%, and 10%. The image forming unit 10 forms the first detection image based on an image signal value of the detection image data. The image signal value of the detection image data is determined in advance.

The first detection image formed on the intermediate transfer belt 5 is read by the optical sensor 7. The analog signal output from the first PD 711 is converted into the digital signal by the A/D converter 110. The CPU 109 controls the image forming condition based on a difference between the digital signal value and a target value. The target value corresponds to an image density tone characteristic to be actually output. The CPU 109 controls the image forming unit 10 by the image forming controller 101 to thereby adjust an image density of black.

Figure 10:
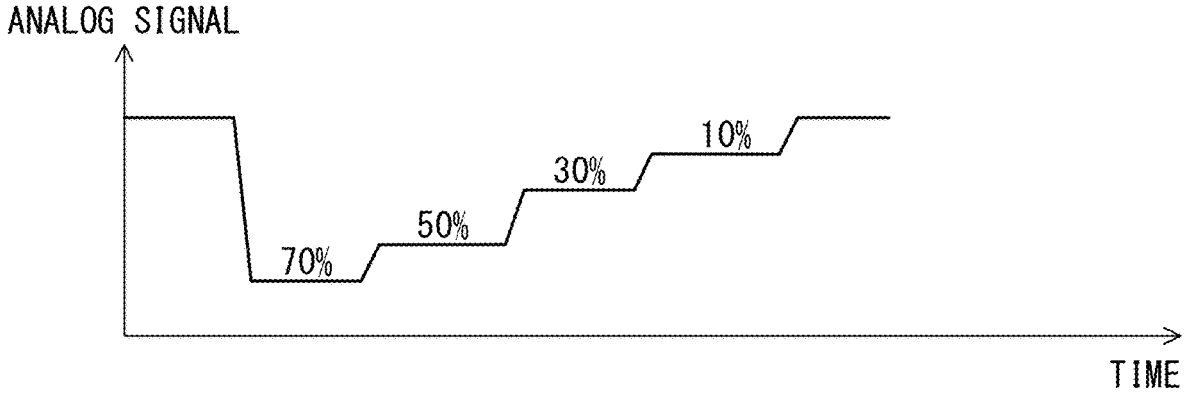
FIG. 10 is a graph for showing an example of an analog signal.

FIG. 10 is a graph for showing an example of an analog signal obtained when reflected light from the first detection image is detected with use of the first LED 701 and the first PD 711. The image of the density of 70%, which is the highest density of the first detection image, is reduced in amount of specularly reflected light (intensity) because a toner adhesion amount is large in addition to the fact that the light is absorbed by the black toner, Therefore, the analog signal (output value) output by the optical sensor 7 (first PD 711) is reduced. The image of the density of 10%, which is the lowest density of the first detection image, is reduced in amount of light absorbed by the black toner as compared to the case of the density of 70%, and the toner adhesion amount is reduced, with the result that the amount of the specularly reflected light (intensity) is increased. Therefore, the analog signal (output value) output by the optical sensor 7 (first PD 711) is increased.

The second detection image is used when scattered reflected light of light emitted from the second LED 702 is received by the second PD 712. The second detection image is used in detecting image densities of chromatic colors, such as yellow, magenta, and cyan, in particular. The second detection image is formed of a tone pattern of four densities: 70%, 50%, 30%, and 10%. In FIG. 9B, a detection image of yellow is illustrated. The second detection images of the colors: yellow, magenta, and cyan are formed on the intermediate transfer belt 5.

The second detection image formed on the intermediate transfer belt 5 is read by the optical sensor 7. The analog signal output from the second PD 712 is convened into the digital signal by the A/D converter 110. The CPU 109 controls the image forming condition based on a difference between the digital signal value and a target value. The target value corresponds to an image density tone characteristic to be actually output. The CPU 109 controls the image forming unit 10 by the image forming controller 101 to thereby adjust image densities of yellow, magenta, and cyan.

Figure 11:
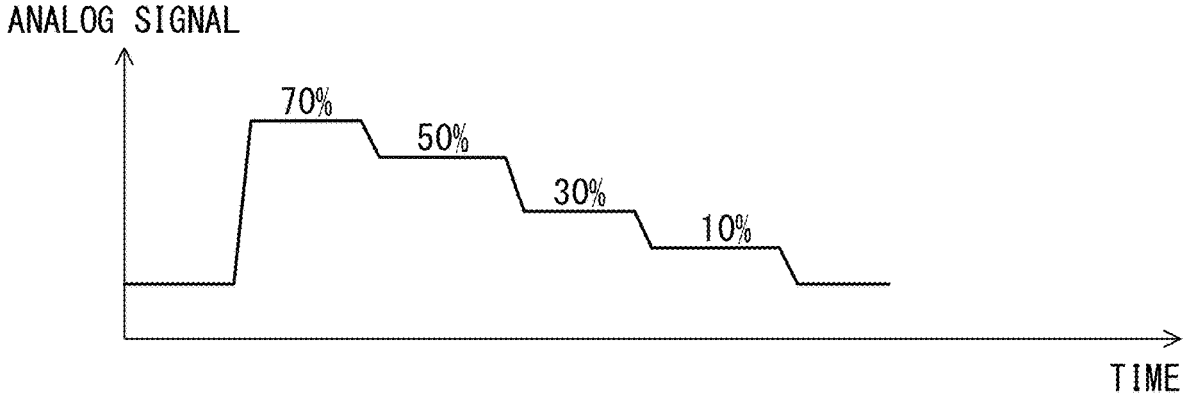
FIG. 11 is a graph for showing an example of the analog signal.

FIG. 11 is a graph for showing an example of an analog signal obtained when reflected light from the second detection image is detected with use of the second LED 702 and the second PD 712. An analog signal of the second detection image for yellow is illustrated here. The image of the density of 70%, which is the highest density of the second detection image, is increased in amount (intensity) of scattered reflected light because a toner adhesion amount is large in addition to the fact that the light is reflected by the yellow toner. Therefore, the analog signal (output value) output by the optical sensor 7 (second PD 712) is increased. The image of the density of 10%, which is the lowest density of the second detection image, is reduced in amount of light (intensity) reflected by the yellow toner as compared to the case of the density of 70%, and the amount of the scattered reflected light (intensity) is reduced. Therefore, the analog signal (output value) output by the optical sensor 7 (second PD 712) is reduced. Analog signals obtained with the second detection images of magenta and cyan exhibit similar tendencies.

<Image Density Correction>

Figure 12:
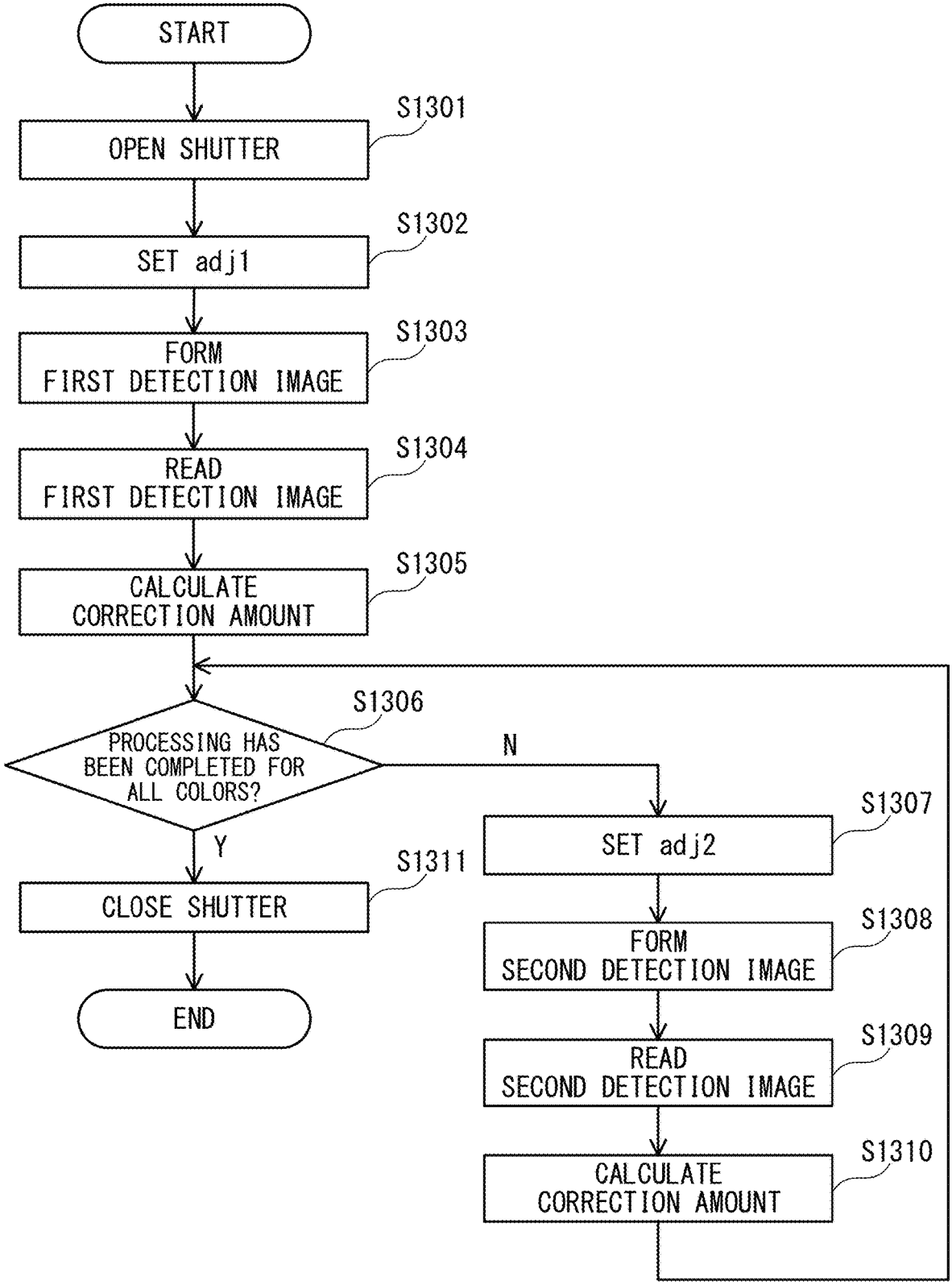
FIG. 12 is a flow chart for illustrating image density detection processing.

FIG. 12 is a flow chart for illustrating image density detection processing in this embodiment. In this embodiment, a description is given of a case in which the image density detection for the chromatic colors is performed after the image density detection for black, but the order may be reversed.

The CPU 109 brings the shutter 210 into the open state (see FIG. 2A) (Step S1301). The CPU 109 reads out the first LET correction coefficient adj1 from the RAM 116 to set the LED current correction ratio corresponding to the first LED correction coefficient adj1 to the LED current adjusting unit 414 of the optical sensor 7 (Step S1302). After that, the CPU 109 transfers the detection image data to the image forming controller 101 to control the image forming controller 101 to thereby form the detection image of black (first detection image) onto the intermediate transfer belt 5 (Step S1303).

The CPU 109 controls, the first LED 701 to emit light and acquires the analog signal from the first PD 711 that has received the specularly reflected light, to thereby read the first detection image (Step S1304). When the first detection image is to be read, the LED current adjusting unit 414 adjusts the current amount to be supplied to the first LED 701 based on the LED current correction ratio corresponding to the LED correction coefficient adj1 and the temperature detected by the temperature detector 413.

The CPU 109 converts an output value of the analog signal corresponding to the read first detection image of black into a value of a digital signal through the A/D converter 110. The CPU 109 calculates the image forming condition (correction amount) from a difference from the image density indicated by the detection image data based on the value of the digital signal (Step S1305). For example, the CPU 109 determines, as the image forming condition for black, a correction amount of an intensity of laser light of the exposure device 15*d*, and stores the correction amount m the RAM 116. When the black image is to be formed, the CPU 109 reads out the correction amount from the RAM 116, and controls the density of the black image to be formed by the image forming unit 10.

After calculating the correction amount of the image density for black, the CPU 109 determines whether the image density detection processing has been performed for all colors of yellow, magenta, and cyan (Step S1306). When the image density detection has not been performed for all colors (Step S1306: N), the CPU 109 first performs the image density detection for yellow.

The CPU 109 reads out the second LED correction coefficient adj2 from the RAM 116 to set the LED current correction ratio corresponding to the second LED correction coefficient adj2 to the LED current adjusting unit 414 of the optical sensor 7 (Step S1307). After that, the CPU 109 transfers the detection image data to the image forming controller 101 to control the image forming controller 101 to thereby form the detection image of yellow (second detection image) onto the intermediate transfer belt 5 (Step S1308).

The CPU 109 controls the second LED 702 to emit light and acquires the analog signal from the second PD 712 that has received the scattered reflected light, to thereby read the second detection image of yellow (Step S1309). When the second detection image is to be read, the LED current adjusting unit 414 adjusts the current amount to be supplied to the second LED 702 based on the LED current correction ratio corresponding to the second LED correction coefficient adj2 and the temperature detected by the temperature detector 413.

The CPU 109 converts an output value of the analog signal corresponding to the read second detection image of yellow into a value of a digital signal through the A/D converter 110. The CPU 109 calculates the image forming condition (correction amount) from a difference from the image density indicated by the detection image data based on the value of the digital signal (Step S1310). For example, the CPU 109 determines, as the image forming condition for yellow, a correction amount of an intensity of laser light of the exposure device 15*a*, and stores the correction amount in the RAM 116. When the yellow image is to be formed, the CPU 109 reads out the correction amount from the RAM 116, and controls the density of the yellow image to be formed by the image forming unit 10.

The CPU 109 repeatedly performs the processing of Step S1307 to Step S1310 until the image density detection is ended for all colors (magenta and cyan). When the image density detection has been completed for all colors of yellow magenta, and cyan (Step S1306: Y), the CPU 109 brings the shutter 210 into the closed state (see FIG. 2B) (Step S1311). After closing the shutter 210, the CPU 109 ends the image density detection processing.

As described above, the image forming apparatus 100 uses the detection image (first detection image, second detection image) for the image density detection Corresponding to the color to be detected to acquire the image density with an optimal combination of a light emitter and a light receiver. Therefore, the CPU 109 can detect a correction amount of an accurate image density to perform highly accurate image density correction. Further, an optimal current amount is supplied to the LED with use of the LED correction coefficient to light the LED at the time of image density detection. Thus, a change in light emission amount of the LED due to heat generation can be suppressed. As a result, stable image density correction can be performed.

As described above, in this embodiment, the output of the optical sensor 7 is monitored while the LED correction coefficient for correcting the current amount of the current to be supplied to the light emitter (LED) is adjusted and the LED correction coefficient i suitably set so as to reduce a change in output value from the optical sensor 7. In this manner, an influence, of a fluctuation in light emission amount due to self-heating of the optical sensor 7 (light emitters) is suppressed. As a result, the optical sensor 7 that operates stably is accomplished. As described above, the present disclosure enables highly accurate control of the light emission amount of the light emitter at the time of detection of the detection image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-065592, filed Apr. 1, 2020, which is hereby incorporated by reference herein in its entirety.

What is claimed is:

1. An image forming apparatus comprising:

an image forming unit configured to form an image on an image bearing member based on an image forming condition;

a transferring unit configured to transfer the image onto a sheet;

an optical sensor including:

a light emitter configured to irradiate the image bearing member with light based on a supplied current; and a light receiver configured to receive reflected light of the light emitted from the light emitter;

a temperature detector configured to detect a temperature of the optical sensor; and a controller configured to:

control the image forming unit to form a detection image on the image bearing member;

control the optical sensor to detect reflected light from the detection image;

adjust the image forming condition based on a result of detecting the reflected light from the detection image by the optical sensor;

control the light emitter to emit light; and generate a correction condition for a current amount to be supplied to the light emitter based on a first output value from the light receiver, which is output when a first time period has elapsed from a start of light emission from the light emitter, and on a second output value from the light receiver, which is output when a second time period different from the first time period has elapsed from the start of the light emission from the light emitter, wherein the controller is configured to determine, in a case where the optical sensor detects the reflected light from the detection image, the current amount to be supplied to the light emitter from the temperature detected by the temperature detector based on the correction condition, and wherein the controller is configured to generate the correction condition based on a difference between the first output value and the second output value.

2. The image forming apparatus according to claim 1, wherein the controller is configured to determine the correction condition based on an output value from the light receiver, which is output when a current is supplied to the light emitter while the current amount is adjusted based on a first correction condition, and an output value from the light receiver, which is output when the current is supplied to the light emitter while the current amount is adjusted based on a second correction condition.

3. The image forming apparatus according to claim 1, wherein the light receiver is arranged at a position where specularly reflected light of the light emitted from the light emitter, which is reflected from the image bearing member, is to be received, and the light receiver is configured to output an output value in accordance with an amount of the received specularly reflected light.

4. An image forming apparatus comprising:

an image forming unit configured to form an image on an image bearing member based on an image forming condition;

a transferring unit configured to transfer the image into a sheet;

an optical sensor including:

a substrate;

a light emitting element configured to irradiate the image bearing member with light, wherein the light emitting element is mounted on the substrate, wherein an intensity of the light is controlled based on a current to be supplied to the light emitting element;

a light receiving element configured to receive reflected light of the light emitted from the light emitting element, wherein the light receiving element is mounted on the substrate; and a temperature detector configured to detect a temperature, wherein the temperature detector is mounted on the substrate, and a controller configured to:

control the image forming unit to form a detection image on the image bearing member;

determine the current to be supplied to the light emitting element from a detection result of the temperature detector based on a determination condition;

control, based on the determined current to be supplied to the light emitting element, the light emitting element to irradiate the detection image on the image bearing member with light;

obtain a receiving result of reflected light from the detection image by the light receiving element; and generate the image forming condition based on the receiving result of the reflected light from the detection image by the light receiving element.

5. The image forming apparatus according to claim 4, wherein the determination condition is correction data representing a correction amount of the current per a unit of temperature.

6. The image forming apparatus according to claim 4, wherein a density of an image to be formed by the image forming unit is controlled based on the image forming condition.

* * * * *